United States Patent [19]

Gansow

[11] Patent Number: 4,877,879

[45] Date of Patent: Oct. 31, 1989

[54] PREPARATION OF POLYETHER COMPOSITIONS

[75] Inventor: Michael A. P. Gansow, Waedenswil, Switzerland

[73] Assignee: Dow Chemical (Nederland) B.V., Terneuzen, Netherlands

[21] Appl. No.: 140,379

[22] Filed: Jan. 4, 1988

[30] Foreign Application Priority Data

Jan. 6, 1987 [GB] United Kingdom ..... 8700101

[51] Int. Cl.[4] ..... C07D 295/12; C07C 47/18; C07C 41/12

[52] U.S. Cl. ..... 544/402; 521/129; 521/167; 521/175; 525/528; 528/73; 528/78; 568/608; 568/620; 568/621

[58] Field of Search ..... 544/402; 521/167, 129, 521/175; 528/73, 78; 525/528; 568/608, 620, 621

[56] References Cited

U.S. PATENT DOCUMENTS

| | | | |
|---|---|---|---|
| 3,000,963 | 9/1961 | Speranza | 568/621 |
| 3,016,404 | 1/1962 | Beauchamp | 568/621 |
| 3,251,787 | 5/1966 | Bedoit | 521/167 |
| 3,251,788 | 5/1966 | Currier et al. | 521/167 |
| 3,299,151 | 1/1967 | Wismer et al. | 521/167 |
| 3,865,806 | 2/1975 | Knodel | 568/620 |
| 4,110,268 | 8/1978 | Longley et al. | 568/620 |
| 4,125,505 | 11/1978 | Critchfield et al. | 524/377 |
| 4,521,548 | 6/1985 | Christen et al. | 521/167 |
| 4,687,851 | 8/1987 | Laughner | 544/401 |
| 4,704,411 | 11/1987 | Gansow et al. | 521/166 |

FOREIGN PATENT DOCUMENTS 1074279 7/1967 United Kingdom .

*Primary Examiner*—Cecilia Shen

[57] ABSTRACT

In an improved process for the preparation of polyether compositions, amine-initiated, alkaline catalyzed polyethers are neutralized with a substantial excess of formic acid that neutralizes the catalyst and stabilizes the resultant composition. This is particularly advantageous where tertiary nitrogen is found in the amine initiator or in the polyether that results.

18 Claims, No Drawings

PREPARATION OF POLYETHER COMPOSITIONS

BACKGROUND OF THE INVENTION

This invention relates to an improved process for producing polyether-containing compositions and more specifically to an improved process for stabilizing a polyether composition prepared from one or more alkylene oxides using an amine initiator. In another aspect the present invention is an improved process for additionally neutralizing the alkaline catalysts used in the production of amine-initiated polyethers. Polyethers, and especially polyether polyols prepared from alkylene oxides have been utilized in lubricants, emulsifiers, plasticizers, solvents and as intermediates in the preparation of polyurethane and polyurethane-modified polyisocyanurate foams.

In general, the production of a polyether from alkylene oxide(s) is ordinarily carried out by the addition of the alkylene oxide(s) to an initiator compound, in the presence of an alkaline catalyst. It has been found very advantageous to use amine-containing initiator compounds in this reaction to achieve a good balance of product properties and process advantages.

It is well known in the preparation of the polyether compositions from alkylene oxides that, after preparation, the products typically require adequate neutralization before the polyethers can be used due to the residues of the alkaline catalysts. This is especially true in the case of such compositions which are used as the intermediates for preparation of urethanetype polymers. If not neutralized sufficiently, the residues tend to catalyze further reactions of the polyethers where such further reactions either are undesirable or are desired to be more controlled and/or predictable. As taught in U.S. Pat. Nos. 4,521,548, 3,299,151, 3,000,963, 3,016,404 and 4,110,268, many types of acids can be used to neutralize the alkaline catalyst. It has been found, however, that the polyether polyol compositions prepared using amine initiator compounds cannot be neutralized and/or stabilized sufficiently using known neutralization compounds and techniques for use in foamable urethane polymers. The rate and amount of foaming of the urethane polymers are generally not sufficiently predictable or reproducible between various samples and the polyols produced tend to have very unsatisfactory dark colors.

SUMMARY OF THE INVENTION

According to the present invention there is obtained an efficient and inexpensive method of stabilizing a polyether composition prepared from one or more alkylene oxides using a amine initiator. In another aspect the present invention is an improved process for additionally neutralizing alkaline catalysts used in preparing amine-initiated polyether compositions. The present invention is a process for stabilizing of a crude polyether composition prepared from one or more alkylene oxides using an amine initiator, comprising oontacting the composition with an effective amount of a reducing agent sufficient to effect said stabilization. In another aspect, the present invention is a process for neutralizing and stabilizing a crude, amine-initiated polyether composition prepared using an alkaline catalyst, comprising contacting the composition with an amount of formic acid in substantial stoichiometric excess with respect to the amount of alkaline catalyst used.

Surprisingly it was discovered that polyether compositions neutralized using excess formic acid are very stable and have sufficiently low degrees of catalytic activity along with low levels of color in the polyether and in foamable and foamed compositions made using the polyether.

DETAILED DESCRIPTION OF THE INVENTION

The process of the present invention is generally applicable to polyether-containing compositions which are prepared using an amine initiator. Methods for preparing such compositions are well-known and generally involve the reaction of at least one alkylene oxide with the active hydrogen-containing amine initiator compound. Such reactions are typically done at least partially in the presence of an alkaline catalyst.

The alkylene oxide is typically a vicinal alkylene oxide such as ethylene oxide, propylene oxide or butylene oxide. These alkylene oxides may be employed either alone or in combination with one or more of the other alkylene oxides. The combinations can be random mixtures and/or separate blocks of the alkylene oxides, with the relative advantages and disadvantages of the different configurations being well-known.

The alkaline catalysts which may be used for the preparation of compositions according to the present invention are well-known and taught in U.S. Pat. Nos. 4,209,609 and 4,110,268. Preferably the alkaline catalyst which is to be neutralized is an alkali metal hydroxide or an alkaline earth metal hydroxide. Potassium hydroxide is the most preferred catalyst in the processes according to the present invention.

The amine initiator compounds suitable for use according to the present invention are similarly known in the art. The present invention is applicable to the use of any aromatic and/or aliphatic amine as an initiator. The present invention is especially applicable to situations where tertiary amines are present either through the complete alkoxylation of a primary or secondary amine, but most especially, when the tertiary amine is present in the initiator compound itself (i.e., prior to its reaction with an alkylene oxide to form a polyether). Ammonia, toluene diamine, ethylene diamine, triethanolamine, triisopropanolamine, diethylenetriamine, crude triethylenetetraamine and aminoethylpiperazine are examples of suitable aromatic or aliphatic amine initiators. As described in U.S. Pat. Nos. 3,251,787, and 3,221,016, and European Patent Application No. 86 305 161, N-aminoethylpiperazine (AEP) is a particularly advantageous amine initiator compound for use in preparation of polyether polyols. Since there is a tertiary amine atom present in AEP the process according to the present invention is particularly applicable to AEP-initiated polyether polyols.

The preparation of the polyether compounds along with the resultant polyether compounds are well-known, with illustrative compounds and methods shown in U.S. Pat. Nos. 3,865,806; 4,125,505; and 4,209,609. The process according to the present invention is particularly applicable in the preparation of linear or branched-chain polyether polyols having an aliphatic or aromatic-aliphatic character. The polyol molecular weight can be up to 10,000, preferably up to 6,000. Typically it is in the general range of 140 to 1100 and is preferably from 250 to 850, more preferably from 300 to 500. Preferred polyols have a hydroxyl number of at least about 200, and preferably within the range of 225 to 700, and most preferably within the range of 400 to 600.

As used herein and generally in this technology, the hydroxyl number is determined by and defined as the number of milligrams of potassium hydroxide required for the complete neutralization of the hydrolysis product of the fully acylated derivative prepared from one gram of polyol or mixture of polyols. It is a dimensionless quantity referring to the functionality and molecular weight of the polyol defined by the following equation:

$$OH=(56.1\times 1000\times f/MW)$$

wherein OH is the hydroxyl number of the polyol, f is the average functionality (number of hydroxyl groups) per molecule of polyol and MW is the average molecular weight of the polyol.

The particular reducing agent to be used and its conditions for use are somewhat dependent on the amine initiator used, the composition of the crude polyether reaction mixture and the concentration of the amine-/alkylene oxide complex. The preferred reducing agent is hydrogen, preferably in the presence of a suitable heterogeneous metallic catalyst, or most preferably generated in situ by hydrogen-generating compounds and/or reactions. In situ hydrogen generation techniques provide more reactive hydrogen and include the known reactions of lithium borohydride and, more preferably, formic acid to produce hydrogen. Since the stabilizing reduction reaction must typically be done subsequent or in addition to the neutralization of alkaline catalyst used in the production of the polyether, it is especially preferred that formic acid be used. Using an amount of formic acid substantially in excess of that amount required to neutralize the alkaline catalyst provides the in situ hydrogen reducing agent for the stabilization of the amine-initiated polyether composition.

The conditions for the formic acid neutralization of the alkaline catalyst are generally known in the art with the heretofore unknown key being the use of an amount stoichiometrically in excess of that which is required to neutralize the amount of alkaline catalyst added. As known in the prior art, the stoichiometric amount typically used to neutralize the alkaline catalyst is about 1 to 1.1 equivalents of formic acid per equivalent of alkaline catalyst employed (i.e., up to a 10 percent excess). It has now been found that with amine-initiated alkaline catalyzed polyether compositions, a substantial stoichiometric excess (i.e., greater than ten percent excess relative to the amount of alkaline catalyst used) of formic acid provides surprisingly improved polyether compositions.

It is theorized that the tertiary nitrogen in the amine initiator or the polyether based thereon reacts with alkylene oxide and produces a dark, color forming quaternary amine complex. It is further theorized that the amount of formic acid in excess of that required to neutralize the alkaline catalyst is decomposed under reaction conditions to form carbon dioxide and hydrogen. The hydrogen then reacts in a reduction reaction with the amine/alkylene oxide complex. AEP-initiated, propylene oxide-containing polyols which have been prepared with a KOH catalyst are representative of this situation. Without this reduction/stabilization, these unstable complexes gradually release the complexed alkylene oxide and are a source of additional basicity. This is an obvious problem for at least two reasons. First, the alkylene oxide is very detrimental to other formulation ingredients such as halocarbon blowing agents. Second, the subsequent reaction of this polyether to form a polyurethane (after varying amounts of storage time) is not reproducible and difficult to control due to the uncertain level of catalyzing action from the added basicity.

Thus, it can be seen that the minimum level of reducing agent or the percentage excess formic acid which is required is somewhat dependent on the concentration of such tertiary amine/alkylene oxide complexes that will result in the polyether composition. Generally the formic acid is used in an excess, based on the amount of alkaline catalyst added, of at least 50 percent, preferably at least 200 percent, and more preferably at least 300 percent.

On the other hand, it has been found that detrimental side reactions of the reducing agent must be avoided. For example, when the formic acid excess is too great, formic acid reacts with the polyol to produce formates which act as a buffer. Upon storage the formates gradually release free acid which, like the increasing basicity, also makes the polyurethane foaming reaction inconsistent. It has been found that the formate content of the polyether compositions can be controlled by using a lower level formic acid in the neutralization and a lower neutralization temperature. The amount of formic acid added can constitute an excess of up to 4000 percent but preferably up to 1500 percent and most preferably up to 700 percent.

The combination stabilization and neutralization is accomplished by adding the formic acid to the polyether composition at or near the end of the alkoxylation process which forms the polyether and achieving sufficient distribution/mixing throughout the reaction mixture. The addition and mixing can be accomplished by known methods such as, for example, the stirring-in of a formic acid solution or the bubbling-in of the formic acid in gaseous form or in a gaseous carrier. The temperature and pressure employed during the neutralization step are not critical to the process but should be selected to achieve complete neutralization of the alkaline catalyst and stay within the parameters necessary for production and processing of the polyether compounds. Typically, with polyether polyols, the temperature at which the formic acid is added should be between 50° and 200° C., preferably within the range of 100° to 160° C., more preferably within the range of 130° to 150° C. and most preferably within the range of 135° to 145° C.

When the neutralization is complete, the reaction mass is stripped to remove remaining volatiles, formic acid, and/or unreacted alkylene oxides. The finished product, preferably a polyether polyol, may be suitably employed in the known applications of such materials. An especially suitable application is the further reaction with a polyisocyanate or similar functioning compound to prepare urethane-type polymers and especially foams of polyurethane and polyurethane-modified polyisocyanurate. The methods and components for preparation of such foams are well-known, including the various catalysts, blowing agents, polyisocyanates and other additives. See, for example, U.S. Pat. Nos. 4,209,609 and 4,302,551.

The following examples are given to illustrate the invention but are not to be construed as limiting its scope. All parts and percentages are by weight unless otherwise indicated.

Experiments

Crude polyether polyols were prepared according to the teachings of EP Application No. 86 305 161.1 wherein N-aminoethylpiperazine (AEP) was used as the initiator and the amounts of the other components are shown in Table I, below. Potassium hydroxide was used in the amounts indicated below as the catalyst. As also indicated below, the propylene oxide used to prepare this polyol was added in an amount sufficient to provide an overall molar ratio of propylene oxide to AEP of 3.9. At the point where propylene oxide addition was complete and the reaction mixture was at a temperature of 150° C., the potassium hydroxide was neutralized using the indicated amounts of formic acid.

TABLE I

| AEP Polyol | |
|---|---|
| Component | Parts by weight |
| AEP | 35.65 |
| Propylene oxide | 64.25 |
| KOH | 0.1 |
| Formic Acid | (as indicated below) |

In the initial attempts to neutralize these polyols for further usage in urethane foams, acetic and formic acids were used in amounts slightly in excess of the amount stoichiometrically required to neutralize the KOH which had been used. When evaluated after initial neutralization and limited storage, the polyols were found to have significantly increased levels of basicity, while containing free propylene oxide and being dark in color. These polyols gave differing and unpredictable foaming activities in preparing urethane foams depending upon their length of storage.

In a further experiment, increased levels of acid were used. Table II, below, shows the storage stability of an AEP initiated polyol neutralized with 0.5 parts by weight (PbW) of formic acid (about a 502 percent excess) in comparison to the same polyol neutralized with about 0.11 PbW acetic acid (about a 10 percent excess). Immediately after neutralization/stabilization, there is no excess formic acid due to its conversion to hydrogen and carbon dioxide which were flashed off.

To show the relative storage stability, the polyols are analyzed by gas chromatography after the indicated time periods to determine in parts per million (ppm) the amounts of propylene oxide (PO), basicity (determined as ppm KOH) or neutralizing acid (ACID) that have been regenerated in the polyol composition during the indicated amounts of time, the lesser amounts indicating greater storage stability. The storage temperature is 50° C. for these and following storage stability experiments.

TABLE II

| Storage Stability of Polyols Neutralized with Excess Formic Acid Versus Excess Acetic Acid | | | | | | | | | |
|---|---|---|---|---|---|---|---|---|---|
| Acid | 1 DAY | | | 2 DAYS | | | 2 WEEKS | | |
| Type | PO | KOH | ACID | PO | KOH | ACID | PO | KOH | ACID |
| Formic | 0 | 0 | 130 | 0 | 0 | 140 | 0 | 0 | 160 |
| Acetic | 660 | 0 | 430 | 1100 | 35 | 0 | 1200 | 140 | 0 |

It should be noted that in the formic acid neutralized polyol, the acid level was also found to remain at 160 ppm after 60 days. As can be seen from this data and the initial experiments, similar advantages in polyether stability are not observed with use of formic acid in stoichiometric or slightly excessive amounts (as suggested by the prior art) nor with excess amounts of other acids normally used for neutralizing polyether compositions, such as acetic acid. Nor would excess amounts of formic acid provide such unexpectedly beneficial results when used to neutralize polyether compositions which have been initiated by typical hydroxy compounds. It is completely unexpected that a substantial formic acid excess would provide such additional stability in a polyol initiated by an amime compound.

The reduction of the alkylene oxide/amine complexes by the hydrogen is confirmed by analysis of polyol volatiles with and without the stabilization step. Without prior stabilization of the polyol, analysis of the volatiles using coupled gas chromatography and mass spectroscopy shows the presence of alkoxylated piperzinoc and morpholines. These are the products that would be expected from the breakdown of the AEP/-propylene oxide complexes. However, similar analysis of the volatiles after the formic acid (i.e. hydrogen) stabilization treatment shows only chemically reduced versions of these breakdown products. The effect of the hydrogen reduction of the complexes is further illustrated by the fact that the dark colored polyol becomes much lighter in color upon reduction of the AEP/propylene oxide, complexes.

Table III shows that the polyols produced by using formic acid neutralization of the catalyst surprisingly have a better, lighter color. In Table III there is a comparison of AEP polyols prepared using the other known finishing methods of neutralization with acetic acid and removal of the catalyst by absorption on a silicate.

TABLE III

| Color of AEP Initiated Polyols Applying Different Finishing Methods | |
|---|---|
| Neutralization Method | Color (Gardener) |
| 0.5 PbW Formic Acid (575% excess) | 6 |
| 0.11 PbW Acetic Acid (10% excess) | 15–18 |
| Silicate removal | 12–13 |

In the following experiments the crude AEP polyol as described above is neutralized at 140° C. with 0.4 parts by weight of formic acid, an excess of about 382 percent. As can be seen, after storage for periods of 1, 30 and 60 days, there is maintained a relatively consistent low level of formic acid (thus no basicity) and no PO is released. The concentrations are in parts per million.

TABLE IV

| Storage Stability (0.4 PbW Formic Acid) | | | |
|---|---|---|---|
| Days | 1 | 30 | 60 |
| ACID | 130 | 140 | 160 |
| KOH | 0 | 0 | 0 |
| PO | 0 | 0 | 0 |

TABLE IV-continued

| Storage Stability (0.4 PbW Formic Acid) | | | |
|---|---|---|---|
| Days | 1 | 30 | 60 |
| FORMATE | 60 | 0 | 0 |

In Table V below a further experiment is shown wherein the crude AEP polyol was neutralized with 1 part by weight formic acid, an excess of about 1105 percent, at temperatures of 150° C. and 160° C. For the polyether compositions neutralized at the indicated temperatures, tests showed the indicated levels of free acid and no free PO nor basicity.

TABLE V

| Storage Stability (1 PbW Formic Acid) | | | | | | |
|---|---|---|---|---|---|---|
| Days | 1 | 6 | 10 | 21 | 34 | 180 |
| 50° C. | 470 | 450 | 370 | 420 | 490 | 660* |
| 160° C. | 270 | 95 | 80 | 156 | 230 | 950 |

*Room Temperature storage after 34 days

As can be seen above, there is a slight increase of free acid with extended storage times due to the acid being released by the formates.

Rigid urethane foams were prepared from the foamable formulation described in Table VI below and the cream time, gel time, and tack free time for the various foams (CT/GT/TFT, these tests being well-known in the art) were measured and are shown in Table VII below.

TABLE VI

| Foamable Formulation | |
|---|---|
| Component | Parts by weight |
| AEP Polyol | 29 |
| Sugar/Glycerine Polyols | 71 |
| Water | 1 |
| Dimethylcyclohexylamine (DMCMA) catalyst | 1 |
| Freon R11 | 35 |
| Silicone surfactant* | 1 |

*TEGOSTAB B 1048, which is a registered trademark of Th. Goldschmidt

TABLE VII

| Foamability Test | | |
|---|---|---|
| Amount of Formic Acid Used to Neutralize the Polyol | | |
| PBW | % Stoichiometric Excess | CT/GT/TFT (sec) |
| 0.3 | 265 | 19/41/56 |
| 1.2 | 1360 | 19/42/55 |
| 2.2 | 2570 | 19/41/55 |
| 3.03 | 3588 | 19/42/55 |

As can be seen from Table VII above the polyether compositions prepared according to the present invention provide very consistent foamable compositions at various formic acid neutralization levels. It is surprising in view of the prior art that use of substantially excess formic acid in the neutralization step would provide these benefits in terms of polyether composition stability, foam production and foam properties.

What is claimed is:

1. A process for stabilizing against release of complexed alkylene oxide, a crude polyether composition prepared from one or more alkylene oxides using an amine initiator in the presence of an alkaline catalyst, comprising contacting the composition with an effective amount of a reducing agent sufficient to effect said stabilization.

2. The process of claim 1 wherein the amine-initiated polyether contains a tertiary nitrogen.

3. The process of claim 2 wherein the amine initiator contained a tertiary nitrogen prior to its reaction with the alkylene oxide.

4. The process of claim 3 wherein the amine initiator is N-aminoethylpiperazine.

5. The process of claim 4 wherein the polyether is the polyether polyol reaction product of N-aminoethylpiperazine (AEP) and one or more alkylene oxides selected from the group of ethylene oxide and propylene oxide.

6. The process of claim 1 wherein the reducing agent is hydrogen.

7. The process of claim 6 wherein the hydrogen is generated in situ.

8. The process of claim 7 wherein the hydrogen is produced by formic acid which additionally neutralizes an alkaline catalyst which has been used in the polyether preparation.

9. A process for neutralizing and stabilizing a crude, amine-initiated polyether composition prepared using an alkaline catalyst, comprising contacting the composition with an amount of formic acid in substantial stoichiometric excess with respect to the amount of alkaline catalyst used.

10. The process of claim 9 wherein the amineinitiated polyether contains a tertiary nitrogen.

11. The process of claim 10 wherein the amine initiator contained a tertiary nitrogen prior to its reaction with the alkylene oxide.

12. The process of claim 11 wherein the amine initiator is N-aminoethylpiperazine.

13. The process of claim 12 wherein the excess is at least 300 percent.

14. The process of claim 13 wherein the alkaline catalyst is an alkali metal hydroxide.

15. The process of claim 14 wherein the alkaline catalyst is potassium hydroxide.

16. The process of claim 15 wherein the polyether composition is a polyether polyol.

17. The process of claim 1 wherein the effective amount of reducing agent is in at least 50 percent excess of the equivalents of alkaline catalyst present.

18. The process of claim 9 wherein the stoichiometric excess is at least 50 percent.

* * * * *

UNITED STATES PATENT AND TRADEMARK OFFICE

CERTIFICATE OF CORRECTION

PATENT NO. : 4,877,879

DATED : October 31, 1989

INVENTOR(S) : Michael August Paul Gansow

It is certified that error appears in the above-identified patent and that said Letters Patent is hereby corrected as shown below:

Column 7, line 18(table V), "50°C." should read -- 150°C. --.

Signed and Sealed this

Third Day of September, 1991

*Attest:*

HARRY F. MANBECK, JR.

*Attesting Officer*

*Commissioner of Patents and Trademarks*